US011078053B2

(12) United States Patent
Golder

(10) Patent No.: US 11,078,053 B2
(45) Date of Patent: Aug. 3, 2021

(54) SUPPORT OF SEGMENTED STRUCTURAL DESIGN

(71) Applicant: STAHL CraneSystems GmbH, Künzelsau (DE)

(72) Inventor: Markus Golder, Künzelsau (DE)

(73) Assignee: STAHL CraneSystems GmbH, Künzelsau (DE)

( * ) Notice: Subject to any disclaimer, the term of this patent is extended or adjusted under 35 U.S.C. 154(b) by 0 days.

(21) Appl. No.: 16/484,357

(22) PCT Filed: Feb. 7, 2018

(86) PCT No.: PCT/EP2018/053080
§ 371 (c)(1),
(2) Date: Aug. 7, 2019

(87) PCT Pub. No.: WO2018/146152
PCT Pub. Date: Aug. 16, 2018

(65) Prior Publication Data

US 2019/0352143 A1 Nov. 21, 2019

(30) Foreign Application Priority Data

Feb. 7, 2017 (DE) ..... 10 2017 102 372.0

(51) Int. Cl.
*B66C 6/00* (2006.01)
*B66C 19/02* (2006.01)
(Continued)

(52) U.S. Cl.
CPC ..... *B66C 6/00* (2013.01); *B66C 19/02* (2013.01); *E04C 3/07* (2013.01); *E04C 2003/0491* (2013.01)

(58) Field of Classification Search
CPC ... B66C 6/00; B66C 19/02; E04C 3/07; E04C 2003/0491; E04C 3/10; E04C 3/08
See application file for complete search history.

(56) References Cited

U.S. PATENT DOCUMENTS 1,012,423 A * 12/1911 Orr ..... E04F 11/02 52/184
1,504,816 A * 8/1924 Cummings ..... E04C 3/02 52/433
(Continued)

FOREIGN PATENT DOCUMENTS

EP 0104915 A2 4/1984
JP S59-77199 A 5/1984
(Continued)

*Primary Examiner* — Adriana Figueroa
(74) *Attorney, Agent, or Firm* — Leydig, Voit & Mayer, Ltd.

(57) ABSTRACT

A structural support that can be used as a truss girder bridge crane, or the like. The support includes one or more rows 13 of segments 15, that are arranged in side by side relation along the length of the support. Each row 13 has extending there through at least one tensioning element 14 which is anchored at opposite ends of the row and is pretensioned with respect to the row in order to hold the segments of the row together. A support preferably includes one row 13 of segments 15 in a lower chord 11 of the support and another row 13 of segments in an upper chord of the support. Vertical framework is mounted between the chords with ends secured adjacent the segments 15 by the tensioning element. The individual segments and the tensioning elements may be directed to a construction site at the location of use and assembled into rows and the appropriate structural construction.

14 Claims, 8 Drawing Sheets

(51) Int. Cl.
*E04C 3/07* (2006.01)
*E04C 3/04* (2006.01)

(56) References Cited

U.S. PATENT DOCUMENTS 1,723,216 A * 8/1929 Stam ..... E04H 12/16 52/223.5
2,645,115 A * 7/1953 Abeles ..... B28B 23/22 52/223.9
2,874,812 A * 2/1959 Clevett, Jr. ..... E04C 3/10 52/223.7
2,877,506 A * 3/1959 Almoslino ..... A63H 33/107 52/223.7
3,140,764 A * 7/1964 Cheskin ..... E04C 3/10 52/223.12
3,152,671 A * 10/1964 Mallory, Jr. ..... E01D 6/00 52/654.1
3,180,013 A * 4/1965 Rote ..... B23K 9/32 29/239
4,144,687 A * 3/1979 Brunes ..... E01D 1/00 198/860.3
4,932,178 A * 6/1990 Mozingo ..... E01D 2/00 52/223.7
5,218,801 A * 6/1993 Hereford ..... E04B 7/022 52/223.9
5,301,482 A * 4/1994 Aspenwall ..... E04C 3/10 312/140
5,323,573 A * 6/1994 Bakewell, III ..... E04B 1/3205 52/223.7
5,809,713 A * 9/1998 Ray ..... E04H 12/04 52/223.7
6,170,209 B1 * 1/2001 Dagher ..... E04C 3/185 52/223.1
6,854,219 B1 * 2/2005 Kelly ..... E04C 3/02 52/245
7,584,584 B2 * 9/2009 Fennell, Jr. ..... E04C 1/40 52/405.3
7,836,646 B2 * 11/2010 Matsufuji ..... E04B 2/42 52/223.7
8,061,095 B2 * 11/2011 Bucheger ..... E04B 2/44 52/223.7
9,255,407 B2 * 2/2016 Burgess ..... E04C 3/40
10,443,239 B2 * 10/2019 Hohmann, Jr. ..... E04C 3/07
2006/0201082 A1 * 9/2006 Hammer ..... E04C 1/395 52/223.5
2006/0283129 A1 * 12/2006 Salhaney ..... E04C 3/11 52/633
2007/0062133 A1 * 3/2007 Branyan ..... E04B 1/04 52/223.7
2010/0307081 A1 * 12/2010 Han ..... E01D 2/00 52/223.7
2012/0023845 A1 * 2/2012 Shockley ..... E04H 7/18 52/223.7
2013/0318896 A1 * 12/2013 Rogers ..... E01C 9/08 52/223.7
2014/0290177 A1 * 10/2014 Nordbrock ..... E04C 3/08 52/838
2018/0274236 A1 * 9/2018 Singleton ..... E04C 3/28

FOREIGN PATENT DOCUMENTS

JP S61-211298 A 9/1986
JP S62-182352 A 8/1987
JP H5-311805 A 11/1993

* cited by examiner

SUPPORT OF SEGMENTED STRUCTURAL DESIGN

FIELD OF THE INVENTION

The invention relates to a structural support, a device comprising a structure support, and to a method for providing the structural support at a location of use.

BACKGROUND OF THE INVENTION

Supports used, for example, as bridge girders for bridge cranes, commonly are welded at the production site and must then, depending on size, be brought to the location of use by means of heavy transport. The organization of such a transport is expensive. The costs for such a transport can be considerable.

OBJECTS AND SUMMARY OF THE INVENTION

It is an object of the present invention to provide a structural support that is relatively simple and desirable in design and lends itself to economical manufacture and easy transport and assembly at a construction site. The invention further relates to a method of providing and assembling such support.

A structural support according to the invention, for example, may be a support for a crane, for example for a bridge crane, a portal crane or a semi portal crane. For example, the support may be a bridge girder of a bridge crane that spans the working space of the bridge girder. Alternatively, by way of further example, the support may be a support for a bridge or for a scaffolding, for example. The support comprises a row of at least two successively arranged segments. For example, the row may comprise three or more successively arranged segments. Preferably, the segments are arranged successively in the longitudinal extent direction of the support. The segments in the row are tensioned relative to each other by means of a tensioning element extending inside the support. The tensioning element is anchored on the opposite ends of the row of segments in order to tension the segments of the row relative to each other.

The support can be transported in individual parts with minimal effort to the location of use because the support is composed of individual segments. A heavy transport is not necessary. The individual parts of the support are more easily transported than the assembled support, even to difficultly accessible locations such as, for example, mountain stations or ski stations.

The tensioning element preferably extends, through the segments of the row. Preferably, the tensioning element is at least as long as two segments. Preferably, the tensioning element projects at least on one end of the row beyond the row of segments. Particularly preferably, the tensioning element projects on both ends through the row of segments beyond the row of segments. Preferably, the tensioning element is anchored on its opposite ends on the outermost ends of the outermost segments of the row. Preferably, the tensioning element is anchored on its opposite ends outside the row of segments extending along the row orientation. For example, the tensioning element can be anchored on its opposite ends outside a row of equally long segments.

The tensioning element may also be referred to as a tendon or a tie rod. For example, it is possible to pretension a tension rod, tension belt, tension rope, tension cable, tension wire or tension strands, for example of prestressing steel, in the tensioning element.

The support may comprise two or more rows of segments. Two rows may extend next to each other or on top of each other. In particular, two rows may extend parallel to each other. One row of segments preferably extends from one end of the support to the opposite end of the support. A tensioning element for tensioning the segments of the row relative to each other preferably extends from one end of the support to the opposite end of the support. When the row extends from one end of the support to the other end of the support, the tie rod extends, accordingly, from one end of the support to the opposite end of the support. Alternatively, the support may comprise, for example, two or more rows arranged successively in longitudinal direction of the support.

At least one additional tensioning element may extend in the support for bracing the segments of the row with respect to each other. For example, two or more tensioning elements may extend from one end to the other end through the row of segments. Preferably, the tensioning elements extend parallel to each other. The additional tensioning element may, for example, extend along the tensioning element on vertically the same level through the row of segments. Tensile forces that are due to a load on the support and act along the row are absorbed by the tensioning element or tensioning elements of the row.

The force for pressing the segments of the row against each other is preferably applied only by the one or more tensioning elements. Screw connections on the adjacent end sides of the adjacent segments, with the aid of which the adjacent segments would be pressed together in longitudinal direction of the row, are not necessary and preferably do not exist.

Preferably, there are no integrally bonded connections such as welded connections between two adjacent segments of a row for connecting the adjacent segments to each other, which connections are put under a tensile stress during operational use of the support in an assembled device.

Between the row and the tensioning element, there are preferably not provided—between the anchoring locations on opposite ends of the row—any connecting locations between the segments of the row and the tensioning element, by way of which connecting locations forces could be transmitted to the tensioning element in row orientation by means of a positive locking connection, integrally bonded connection and/or frictionally locking connection. Preferably, the row of segments is connected only by force application to its ends with the tensioning element or elements for the row in longitudinal direction of the tensioning elements.

The support can be assembled particularly easily, for example at the location of use of the device. The connection of the segments of the row to each other occurs preferably only by bracing the segments with respect to each other by means of one or more tensioning elements that extend through the row of segments and are anchored at the ends of the row. As described, connections by means of screws between adjacent segments, or welded connections between adjacent segments, for the connection of adjacent segments that would be loaded in tension can be omitted.

Adjacent segments of the row that are braced with respect to each other on their end sides may be in direct contact with each other at their end sides, or an element or a stack of elements, for example one or more metal sheets stacked in row orientation, may be arranged between adjacent segments. Elements arranged between two adjacent segments in a row are clamped—preferably due to the due to the force that compresses the adjacent segments due to the pretensioning of the tie rod—between the adjacent segments of the row. An element may be clamped between a pair of adjacent elements or more than a pair of adjacent segments. The pairs between which the element is clamped may belong to different rows of segments. Preferably, there is no additional connection apart from the clamping connection of the element between one or more pairs of adjacent segments thereof or of different rows, which additional connection would prevent the element from performing a movement relative to the segments between which the element is clamped.

If a maximum loading capacity is specified for the support, the segments are preferably pretensioned relative to each other in such a manner that, even if a load is applied to the support, in particular transversely, for example perpendicularly, to the support longitudinal axis, no gaps will open between the segments under a load corresponding to the maximum loading capacity. Consequently, there will be no wide gaps opening up between adjacent segments.

Along their longest dimension, the segments preferably extend along the longitudinal extent of the row. The respective dimension (length) of the segments along the longitudinal extent of the row is, accordingly, preferably greater than the respective width and/or the respective height of the segments (transversely with respect to the length extent). Preferably, the length of the segments is a maximum of 1.2 meters. Consequently, the segments can be transported on Europool palettes.

Preferably, the row is made up of segments having the same lengths. If the row extends from one support end to the opposite support end, the segments of the row preferably have the same length, with the exception of at most one or two or three segments for the length adaptation of the support. If one or two or three segments of different lengths are used, the segment having the differing length may be arranged, for example, on one end of the row, or the two segments having different lengths may each be arranged on one end, respectively, for example.

If the supports according to the invention are essentially made up of segments having the same lengths, the production costs for the support and the costs for the maintenance of the segments can be particularly low.

Preferably, the segments consist of steel, for example of structural steel, or aluminum.

Preferably, the segments have a bottom, a cap and two lateral walls that preferably extend in row orientation between bottom and cap, in which case the cap, the bottom and the lateral walls enclose a space trough which the tensioning element or elements of the row may extend. For example, segments of the row may be assembled of box sections, e.g., square or rectangular tubes. Otherwise, segments may be made of a U-beam that extends along the support, in which case the space that is partially enclosed by the U-beam is closed in upward or downward direction by a flat section. Caps and/or bottoms can be connected to the lateral walls, for example by welded or screw connections.

The tensioning element may be anchored on the ends of the row by positive locking and/or frictional locking connection in order to transmit the force due to pretensioning to the row. Preferably, an anchor element of the tensioning element is fastened to the tensioning element for one end of the row, with which the force due to pretensioning can be transmitted to the row of segments in order to compress the segments of the row. Preferably, respectively one anchor element is provided for respectively one end of the row. By means of the anchor elements on one or both sides of the row of segments, it is possible to transmit the force, for example via one, or respectively one, positive locking connection, to the row. The anchor element on one end can support itself, due to pretensioning the tensioning element, on one end section of the outer segment of the row. Alternatively, the tensioning element can support itself, for example on one element or a stack of elements that are clamped between the end section and the anchor element. The tensioning element can at least support itself with one anchor element inside the outer segment. However, preferably, the tensioning element is anchored outside the outer segment. Preferably, the tensioning element supports itself outside the row. Preferably the row of segments is arranged, accordingly, between the support locations. For example, the anchor element can support itself on the end side of the outer segment on the end, or the anchor element supports itself on an element or a stack of elements clamped between the anchor element and the end side. The anchor element for the opposite end of the row can support itself accordingly as described hereinabove. Particularly preferably, the anchor elements arranged on both ends support themselves, respectively, on one element or stack of elements that are respectively clamped between the respective end sides and anchor elements.

The tensioning element, designated as tensioning element (14) in the following detailed description (see FIG. 5), may be constructed of two tensioning element segments (14*a*) that are fastened to each other between the ends of the tensioning element. The tensioning element segments extend along the longitudinal direction of extent of the tensioning element. The length of the tensioning element segments is preferably at least ten times greater than their extent, for example the diameter, transversely with respect thereto. Particularly preferably, the tensioning element (14) is assembled of up to at most one or two tensioning element segments (14*a*) of tensioning element segments having the same lengths. If any, the tensioning element segment or segments (14*a*) having different lengths may act as length compensation. Alternatively, the tensioning element segments of the tensioning elements have the same length. In this manner, equal tensioning element segments can be used for supports having different lengths, thus making the manufacture and availability of the tensioning element segments more cost-effective. In order to connect two tensioning element segments, it is possible to arrange, between the tensioning element segments (14*a*), a connecting piece (14*b*) (FIG. 5) that is separate from the one and/or the other tensioning element segment, in which case the connecting piece may be threaded on its ends, such threading interacting with corresponding threads of the tensioning element segments in order to connect the tensioning element segments to each other.

The support may be a box girder. Particularly preferably, however, it is a truss girder. Truss girders may have a low inherent weight, as well as display minimal susceptibility to wind loads. Due to the segmented structural design of the support according to the invention and the fastening of the segments of the row to each other by means of one or more tensioning elements, the truss girder can be installed with relatively minimal effort.

A truss girder according to the invention comprises at least one row of segments that are braced with respect to one another by means of a tensioning element. Preferably, at least one such row of segments is in the lower chord of the truss girder, and/or at least one such row of segments is in the upper chord of the truss girder. For example, in the lower chord, there are arranged two parallel rows of segments, and/or in the upper chord there are arranged two parallel rows of segments, respectively next to each other. For example, two tensioning elements per row of segments may extend in the lower chord and/or in the upper chord through the row.

Between the truss girder's upper chord divided into segments and the lower chord divided into segments, there may be arranged sections of framework elements (abutments) extending inclined with respect to the horizontal and the vertical, and vertically extending section of framework elements (posts). Preferably, however, the truss girder does not need sections of framework elements that extend vertically from the lower chord to the upper chord. However, in one embodiment, there can be arranged vertically extending framework elements, e.g., metal sheets, for example in a length adaptation section of the support in order to adapt the length of the support. However, preferably, there are no vertical framework elements, e.g., vertically arranged metal sheets, outside the length adaptation section. The abutments and, if any, preferably also the posts are sheet metal parts. The abutments and/or the posts have end sections that preferably extend in vertical direction.

The end sections of framework elements arranged at the ends of the row can be arranged respectively between the outer segment of the row at the end, at which the respective framework element is arranged and may be held braced with respect to the outer segment. Preferably, the end sections of the outer framework elements are respectively clamped between the outer segment and the outer part by tensioning the row of segments by means of the tensioning element. End sections of framework elements arranged between the outer framework elements are, alternatively or additionally, preferably held between adjacent segments. Particularly preferably, the end sections of framework elements arranged between the outer framework elements are clamped between adjacent segments, respectively by tensioning the row of segments by means of the tensioning element. Particularly preferably, the end sections of rods arranged between the outer rods are held only by being clamped between the segments. Accordingly, by clamping, preferably a force is applied to the end sections, so that the end sections are prevented from a movement transverse, for example perpendicular, with respect to the adjacent segments by the clamping action, even if the device in which the support is set is loaded with the maximum load consistent with the design of said load.

The device according to the invention comprising at least one support according to the invention may be a crane, in particular a bridge crane, a portal crane or a semi portal crane. Alternatively, the support may be used, for example as the support of a scaffolding or of a bridge. The device may be a sign gantry for mounting traffic signs or directional signs over the lanes of a road or an expressway. For example, the segments may be short enough that a successive arrangement of at least two or at least three segments of the row of the support according to the invention is required, so that the successively arranged segments together span a lane of the road or expressway. The support set into the device preferably extends in horizontal direction. Preferably, the support extends in longitudinal extent direction of the device (longitudinal support). Alternatively, the support according to the invention may also be arranged vertically. The device according to the invention comprising at least one support according to the invention may be, for example, a stacker crane or a rotating tower crane, each potentially comprising a mast with at least one vertically arranged support according to the invention.

In order to arrange the support in the device, the device may comprise at least one connecting element, for example. The connecting element may be arranged transversely, in particular perpendicularly, to the longitudinal extent of the row of segments and be arranged on one end of the support. In a preferred embodiment, two connecting elements may be provided that, preferably, are arranged on opposite ends of the support, in which case at least one row of segments extends preferably from the one connecting element to the other connecting element. The connecting element extending transversely, in particular perpendicularly, to the longitudinal extent of the row of segments may be am end carriage, for example. Such end carriages are arranged, for example, on the ends of a bridge support of a bridge crane. Preferably, the tensioning element is anchored and pretensioned at least at one end of the row of segments on a section of the connecting element that is arranged on the end, in order to brace the segments in the row with respect to each other and with respect to the connecting element by means of the tensioning element. If, for example, the device comprises an end carriage that is arranged on one end of the support, the tensioning element may be anchored in the end carriage example, in order to mount the end carriage—by tensioning the end carriage against the segments of the row—to the support by means of the tensioning element. If the connecting element or elements are pressed respectively against one end of the row of segments, the connecting element or elements are fastened to the support in a simple manner. Between the connecting element and the outer adjacent segment of the row that has been tensioned against the connecting element by means of the tensioning element, it is possible to clamp one or more additional elements or also no additional elements. For example, an end section of a framework element can be clamped between the connecting element and the outer segment when the support is a truss girder. As an alternative or an addition to an installation by bracing, the support against the connecting element by means of the tensioning element, the support may be fastened to the connecting element by the respective end, for example on one end of the support or on both ends of the support, by means of a screw connection. Independent of the manner of mounting the support to the connecting element, a truss girder according to the invention may be mounted, for example, to the ends of the lower chord and/or the upper chord, to the connecting elements.

The organization and the expenses of a heavy transport or a special transport are omitted, when the support is made available at the location of use in that the segments have been individually made available at the location of use and the segments are arranged and braced with respect to each other in the row only at the location of use.

In order to make the support available, the segments are arranged in one row or several rows. This may be accomplished by using positioning aid elements that preliminarily fixate adjacent segments in a desired position transverse, for example perpendicular, to the longitudinal extend direction of the row of segments and potentially additionally in the longitudinal extent direction. Preferably, however, the positioning aid elements are not suitable to ensure the connection of two adjacent elements when the support is loaded with a load corresponding to the maximum load capacity of the support or when the device that contains the support is loaded with a load for which the device is maximally designed. The positioning aid elements can only assist in the positioning and arrangement of the segments in the row. By pretensioning the tensioning element or elements for the row, the segments of the row are subsequently braced with respect to each other. To do so, forces are applied, in the direction of the longitudinal extent of the tensioning element, to the row of segments with the aid of the tensioning elements from the ends of the row in order to press the segments against each other. The preliminary tensioning of the tensioning element or elements of the row is preferably high enough that, even when the support is loaded with the maximum load for which the support is designed, there will be no stress on a connection of a positioning aid element with a segment of the row, when loaded in tension in the direction of the longitudinal extent of the tensioning element or elements.

The pretensioning of the tensioning element or elements of a row is preferably selected high enough that the segments of the row—even when the support is loaded with the maximum load for which the support is designed—are prevented, only by tensioning the segments by means of the one or more tensioning element, against at least one adjacent segment from moving in longitudinal extent direction of the row and in a transverse direction, for example perpendicularly, relative to the adjacent segment of the row. Preferably, there are no additional connecting means between two adjacent segments. Preferably, there are no screw connections on adjacent ends of two adjacent segments for connecting the adjacent segments. Accordingly, alternatively or additionally, there are no weld connections loaded in tension in longitudinal extent direction of the tensioning elements between two adjacent segments for the connection of the adjacent segments.

When the segments of a row are pressed against each other by the tensioning elements in order to form a frictional locking connection, this may potentially not be sufficient with a low coefficient of friction in order to prevent a movement of adjacent segments relative to each other in transverse direction, for example perpendicular direction, with respect to the longitudinal extent of the adjacent segments, in particular in vertical direction. Therefore, it is possible in one embodiment to arrange—on adjacent ends of adjacent segments—a positive locking element, for example, of steel, in particular of structural steel or aluminum, in which case the arrangement is disposed to form a positive locking connection between the adjacent segments that prevent a movement of the adjacent segments relative to each other, in transverse direction, preferable perpendicularly, to the longitudinal extent direction of the segments. For example, on adjacent ends of adjacent segments, the positive locking element may be plugged, into adjacent segments, or the adjacent ends of the segments and plugged into the positive locking element, for example.

In an exemplary embodiment, the positioning aid elements initially act to facilitate the assembly of the support and act, in the assembled support, as the positive locking elements against a shifting of the adjacent segments relative to each other—despite any bracing by means of the tensioning element or elements.

Other objects and advantages of the invention will become apparent upon reading the following detailed description and upon reference to the drawings.

Figure 1:
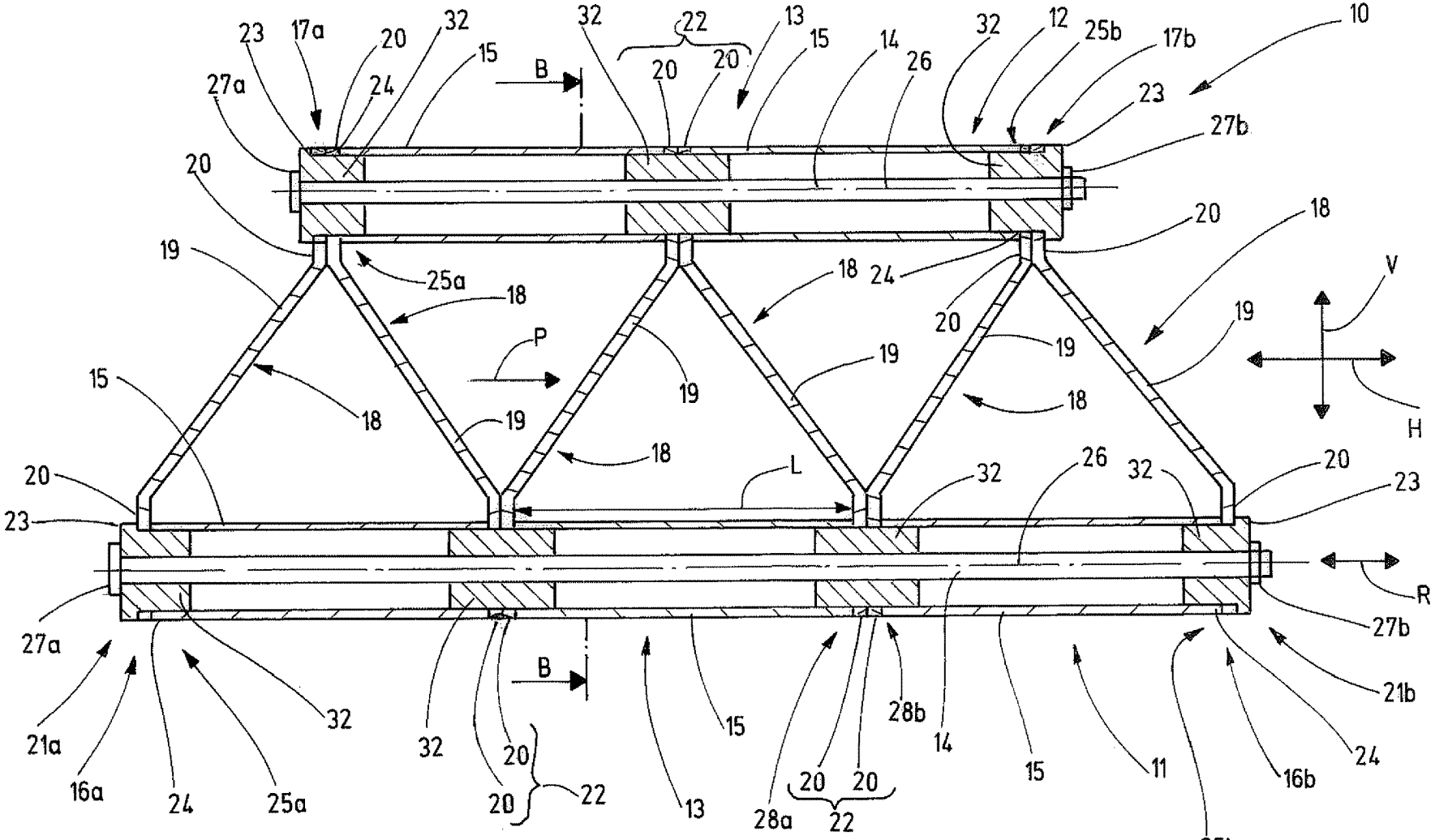
FIG. 1 is a longitudinal vertical section of an illustrated structural support in accordance with the invention, having a truss construction.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE PREFERRED EMBODIMENTS

Figure 2:
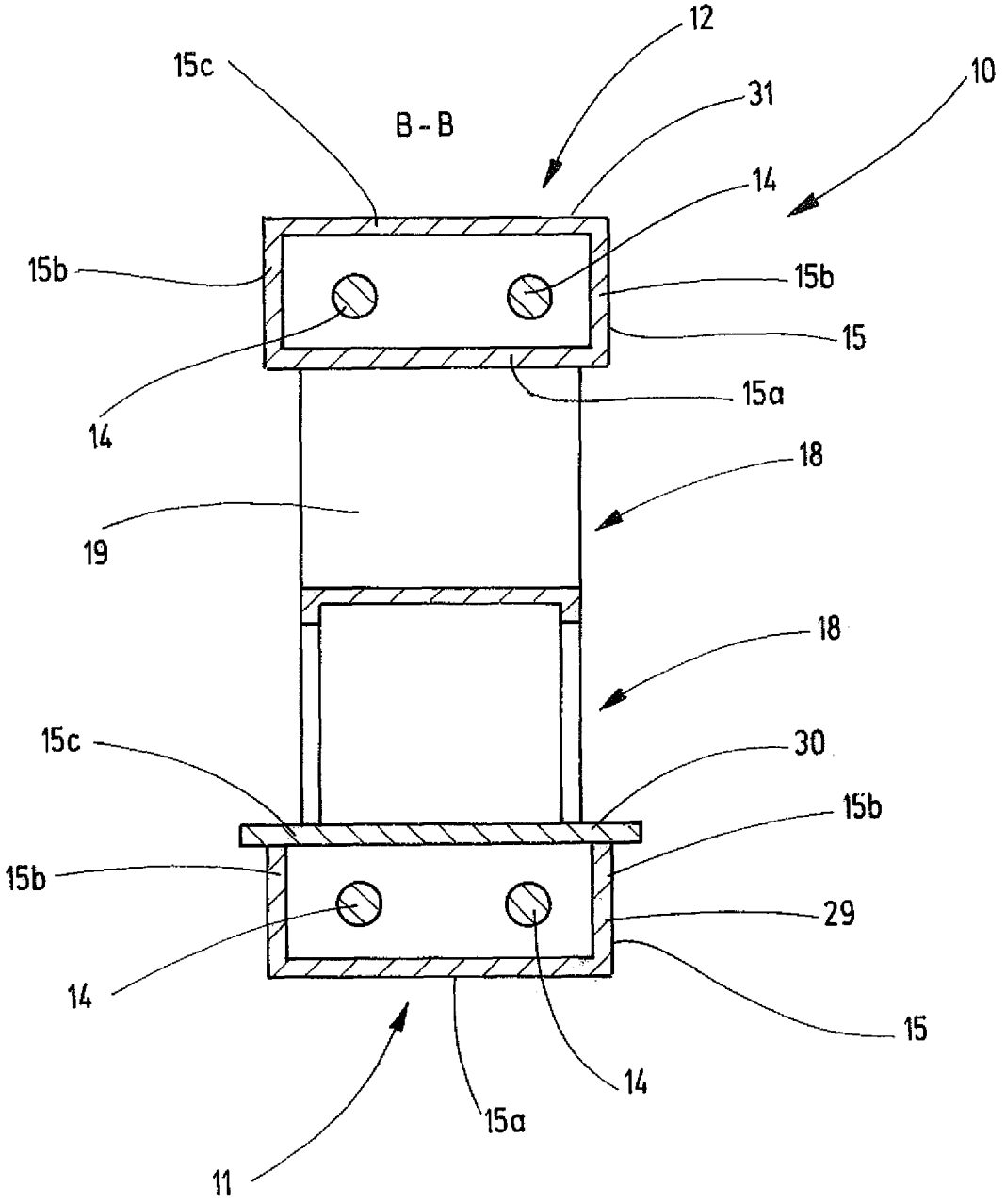
FIG. 2 is an enlarged longitudinal vertical section of the structural support shown in FIG. 1 taken in the plane of line B-B.

Referring now more particularly to FIGS. 1 and 2 of the drawings, there is shown an illustrative structural support 10 in accordance with the invention. The illustrated support 10 may be a truss girder support which comprises a lower chord 11 and/or an upper chord 12 in a segmented structural design with segments 15 in respective rows 13 that are braced with respect to each other by means of at least one tensioning element 14 in each row 13. Such support 10 in a truss girder design can comprise, for example, the horizontal upper chord 12 and the horizontal lower chord 11 which in this case each have a trapezoidal design. However, the support 10 according to the invention may also, alternatively, have a different framework form. As an alternative to the truss girder design, the support 10, may for example, be configured as a box girder (not illustrated) with a row of box-shaped segments, whose upper sides may form the upper chord of the support and whose lower sides may form the lower chord of the support.

In the truss girder support 10 depicted in FIG. 1 and FIG. 2, the lower chord 11 and the upper chord 12 each have a row 13 of segments 15. Alternatively, there may be more than one row 13 next to each other in the lower chord 11 and/or the upper chord 12. It is preferred if two rows 13 are in the lower chord 11 and/or two rows 13 in the upper chord 12. Preferably, the other row 13 extends in the lower chord 11 and/or in the upper chord 12 along the at least one row 13, and preferred on the same level. The row 13 of the upper chord or the rows 13 of the lower chord 11 as shown preferably reach from one end 16*a* of the lower chord 11 to the longitudinally opposite end 16*b* of the lower chord. The row 13 or the rows 13 of the upper chord 12 also preferably extend from one end 17*a* of the upper chord 12 to the longitudinally opposite end 17*b* of the upper chord 12.

The depicted support 10 comprises framework elements 18 with framework element sections 19 that are inclined relative to the horizontal H and to the vertical V between the lower chord 11 and the upper chord 12, such sections also being referred to as abutments. The illustrated truss girder support 10 does not need vertical rods or posts. Alternatively additionally, the truss girder support 10 may have posts. The framework elements 18 have end sections 20 that in this case extend in the vertical direction V.

The row 13 of segments 15 in the lower chord 11 extending from one end 21*a* of the support 10 to the opposite end 21*b* of the support 10 has, in the depicted exemplary embodiment, three successively arranged segments 15. Between two adjacent segments 15, there is clamped, respectively, a stack 22 with two end sections 20 of the framework elements 18 arranged successively along the row 13, with the arrangement pressed against each other.

In the upper chord 12 of the depicted exemplary embodiment, the row 13 has two successively arranged segments 15, wherein—between the adjacent segments 15—there is respectively clamped one stack 22 with two end sections 20 of the framework elements 18 which are pressed against each other.

Respectively one end element 23 is arranged on the ends 16*a*, 16*b* of the lower chord 11. On each end 16*a*, 16*b* between the end element 23 and the end side 24 of the outer segment 15 of the row 13 of the lower chord 11, there is clamped an end section 20 of the outer framework element 18, with the adjacent segments 15 pressed against each other.

Likewise, there is arranged respectively one end element 23 on the ends 17*a*, 17*b* of the upper chord 12. On each end 17*a*, 17*b*, there is clamped, between the end element 23 and the end side 24 of the outer segment 15 of the row 13 of the upper chord 12, an end section 20 of the outer abutment element on the end, with the end element 23 pressed against the end side 24 of the outer segment 24.

According to an important feature of the illustrated embodiment, the clamping force for clamping the end sections is applied by compressing the end elements 23 and the segments 15 of row 13 by means of at least one pretensioned tensioning element 14. In the depicted exemplary embodiment according to FIGS. 1 and 2 two tensioning elements 14 extend parallel to each other through the row of segments 15 in the lower chord 11 and in the upper chord 12. In the representation of FIG. 1, one tensioning element 14 is covered by the other, because the tensioning elements 14 of a row extend on the same level. In the representation of FIG. 2, the parallel tensioning elements 14 are shown in cross-section through the exemplary embodiment. Instead of two tensioning elements 14 for compression of the segments 15 of a row 13, it is possible for at least one row 13, to provide, alternatively, only one tensioning element 14 or more than two tensioning elements 14 that extend through the segments 15 of the row 13 and compress the segments 15 of the row 13.

The following explanation regarding one tensioning element 14 applies to all tensioning elements for rows 13 that are arranged in the support 10, unless stated otherwise: In the depicted exemplary embodiment according to FIGS. 1 and 2, the tensioning element 14 extends through the segments 15 beyond the ends 25*a*, 25*b* of the row 13 of segments 15. For example, the tensioning element 14 may comprise a pretensioned rod, a rope, a truss or a strand. In the depicted exemplary embodiment, a rod 26 of prestressed steel is loaded in tension. The tensioning element 14 comprises oppositely located anchor elements 27*a*, 27*b* arranged outside the row 13 of segments 15, said anchor elements being fastened to the rod 26 that is loaded in tension. Accordingly, the tensioning element 14 is anchored to the ends 25*a*, 25*b* of the row 13 outside the row 13 of segments 15 extending along the row orientation R, said ends being opposite each other in row orientation R. In the exemplary embodiment, the rod 26 for anchoring a head 27a to one end of the rod 26 and to the opposite end of the rod 26 is provided with an outside thread that is engagement with a nut 27*b*. Alternatively, for example, both ends of the tensioning element 14 may be provided with an outside thread, each of them being in engagement with nuts 27*b* on both ends.

In the depicted exemplary embodiment, the pretensioned tensioning element 14 braces itself with the anchor elements 27*a*, 27*b* against the oppositely arranged end elements 23 of the truss 11, 12 in a positive locking manner in opposite direction in order to compress the end elements 23 arranged due to the pretensioning in the rod 26 between the anchor elements 27*a*, 27*b*, the interposed segments 15 of the row 13, as well as the end sections 20. On each end 25*a*, 25*b* of the row 13 the end element 23 again braces itself against a stack of elements which in the depicted exemplary embodiment, is a stack of end sections 20, that brace themselves against the end side 24 of the outer segment 15 on the end 25*a*, 25*b*. As a result of this, adjacent segments 15 are pressed against each other and the end sections 20 of the framework elements 18 are clamped between the adjacent segments 15 or between an end element 23 and an adjacent segment 15.

The long tensioning element 14 has a relatively soft force/path characteristic. As a result of this, the connection of the segments 15 of the row 13 to each other by means of the tensioning element or elements 14 of the row 13 display high fatigue strength. This imparts the support with high fatigue strength even with dynamic stresses. This also applies to connections between the support 10 and the connecting elements of a device according the invention, said connections being provided by the tensioning element or tensioning elements 14, as will be apparent from the description of the exemplary embodiment according to FIGS. 3 and 4. In addition, the pretensioned tensioning element 14 also imparts the connections with high fatigue strength in the event of extreme temperature fluctuations.

Between the two force-introducing locations on the ends 25*a*, 25*b* of the row 13—in the exemplary embodiment between the support locations of the two anchor elements 27*a*, 27*b*—the tensioning element 14 is not connected to the row 13 of segments 15 in a force-introducing manner. The tensioning element 14 braces itself between the two support locations of the anchor elements 27*a*, 27*b*, but not at other support locations, in order to transmit tensile forces in pretensioning direction along the longitudinal extent of the tensioning element 14.

Two adjacent segments 15 of a row 13 are pressed against each other preferably only by the compressive force introduced by means of the tensioning element or tensioning elements 14 of the row 13 into the row 13. There is preferably no screw connecting device on the adjacent ends 28*a*, 28*b* of the adjacent segments 15 for compressing the adjacent ends 28*a*, 28*b* of the segments 15, in particular the end sides 24 of the segments 15 against each other—with or without elements arranged between the end sides 24.

The pretensioning of the tensioning elements 14 in the lower chord 11 and/or in the upper chord 12 are preferably such that—only by pretensioning, even with a load of the device that is placed in the support—there will not occur an opening of gaps between adjacent segments 15 of the row 13 in the lower chord 11 and/or in the upper chord 12, even with a maximum load for which the device is designed. Between the respectively two adjacent segments 15 of a row 13—in the exemplary embodiment in particular row 13 in the lower chord 11—there is preferably, for example, is no screw connection for connecting the adjacent segments 15 to each other on adjacent ends 28*a*, 28*b* of the segments 15, which screw connection would, during operational use of the support 10 in a device, load the row 13 in tension along the pretensioning force of the tensioning elements 14 of row 13. In addition, there is preferably no integrally bonded connection such as a weld connection between two segments 15 of a row 13, which could connect the segments 15 to each other and which would apply tensile stress along the pretensioning force of the tensioning elements 14, because, preferably due to the pretension ing of the tensioning elements 14 of row 13, even without such an integrally bonded connection, a gaping apart of two adjacent segments is would not occur, by stressing the device with a maximum load for which the device is designed.

The adjacent segments 15 are prevented from moving relative to each other, in particular perpendicularly, with respect to the pretensioning force by pressing the adjacent segments 15 against each other due to the pretensioning of the tensioning elements 14 of row 13. Additional connecting devices between the adjacent segments 15 of row 13 that would apply stress—during the use of the support 10 in the device when the device is in operational use—in transverse direction, in particular in perpendicular direction with respect to the tensioning force due to the load on the device, are preferably not necessary or provided.

The segments 15 may consist, for example, of steel, in particular of structural steel or aluminum. In the exemplary embodiment, the segments have the form of a box with a bottom 15*a*, two lateral walls 15*b* and a cap 15*c*. For example, the segments 15, in particular those of the lower chord 11 may be made of a U-beam 29 whose enclosed space, as in the depicted exemplary embodiment (FIG. 2) is covered upward by a flat section 30, wherein the flat section 30 forms the cap 15*c*. Alternatively, the U-beam 29 may be arranged so as to be open downward and be closed downward by means of the flat section 30, said section in this case forming the bottom 15*a*. The U-beam 29 and the flat section 30 can be welded or screwed together, for example. As depicted in the exemplary embodiment (see FIG. 2), the flat section 30 may slightly laterally project beyond the U-beam 29. When the support 10 is used in a crane, the flat section 30 can provide a running surface for the trolley of the crane. As an alternative to the design using the U-beam 29 and the flat section 30, a segment 15 can be made of a rectangular tube 31, for example. In the depicted exemplary embodiment, the segments 15 in the upper chord 12 are constructed of rectangular tubes. 31.

In the depicted exemplary embodiment all segments 15 of the support 10 are of the same length, in which case it is also possible, for example, that the segments 15 in the lower chord 11 have a uniform length that is different from a uniform length in the upper chord 12. Alternatively, one or two segments 15 in the upper chord may have a length different from the other segments 15 of the support 10 or the lower chord 11. Alternatively or additionally, for example one or two segments 15 in the upper chord 12 may have a different length. The one segment 15 or both segments 15 in the lower chord 11 and/or in the upper chord 12, can be designed to adapt to the length of the support 10 to the specifications of a device for the support 10. Arranged on a segment 15 having a different length, there may be a framework element 18 with a different angle of the framework element section 19 relative to the horizontal and the vertical. The angle of the framework element section 19 of this framework element 18 may be adaptable so as to be able to use the framework element 18 with segments 15 having different lengths. Otherwise, it is possible to provide supports 10 having different length by the appropriate selection of the segments 15 in the lower chord 11 and the upper chord 12, respectively. If the segments 15 that are used in the lower chord 11, in the upper chord 12 and/or in the entire support 10 have the same length or have the same length with the exception of one or two or three segments 15, the warehousing of the segments 15 and the assembly of the support 10 are particularly efficient. Preferably, each segment 15 is not longer than 1.2 meters. Thus, the segments 15 are preferably no longer than Europool palettes.

The framework elements 18 are preferably sheet metal parts, preferably steel sheet parts, in particular structural steel sheet parts, or aluminum sheet parts. The metal sheet may be canted in the framework element section 19 of the framework element 18 between the upper chord 12 and the lower chord 11, as can be seen in FIG. 2, in order to increase the stiffness of the framework element section 19. The two end sections 20 of a sheet metal part are respectively pressed against at least one segment 15 in the upper chord 12 and at least one segment 15 in the lower chord 11. The end sections 20 of framework elements 18 arranged between the outer framework elements 18 are clamped between adjacent segments 15. In doing so, the end section 20 can be in contact with the segment 15, or, between the end section 20 and the segment 15 against which the end section 20 is pressed there are arranged one or more additional elements, e.g., an end section 20.

The tensioning element 14 or the tensioning elements 14 in the lower chord 11 and/or in the upper chord 12 may be assembled of at least two individual tensioning element segments (not illustrated). The tensioning element segments extend in the assembled tensioning element 14 along the longitudinal extent of the tensioning element. In order to connect the tensioning element segments to each other, it is possible, for example, to use connecting pieces (not illustrated) between adjacent tensioning element segments, for example, in which case the tensioning element segments are fastened, for example, by screw connection and/or clamping connection in the connecting piece. The tensioning element segments may have a length of at most 1.2 meters.

On the adjacent ends 28*a*, 28*b* of adjacent segments 15 of a row 13 and/or on the ends 25*a*, 25*b* of the row 13, there can be provided positioning aid elements 32, for example of steel, in particular structural steel or aluminum, for positioning the segments 15 and/or for positioning the framework elements 18. In the exemplary embodiments according to FIGS. 1 and 2 the positioning aid elements 32 are arranged on the adjacent ends 28*a*, 28*b* of adjacent segments 15, as well as on the ends 25*a*, 25*b*. Their use will be explained further within the context of an exemplary representation of a method for providing a support 10, for example the support 10 according to FIG. 1, at a location of use:

The individual parts of the support 10, which, in the exemplary embodiment, include at least the segments 15, the framework elements 18, the end elements 23, as well as the tensioning elements 14, and the positioning aid elements 32, are transported to the construction site at the location of use. The end elements 23, the segments 15 of the lower chord 11 and the segments 15 of the upper chord 12, as well as the framework elements 18, are arranged successively for the arrangement according to FIG. 1. For positioning two adjacent segments 15 in the row 13 relative to each other, in particular with respect to the relative mutual arrangement transverse with respect to row orientation R, and for positioning the end sections 20 of the framework elements 18 between adjacent segments 15, in particular with respect to the relative mutual arrangement transverse to row orientation R, the positioning aid elements 32 may be arranged on the ends of the segments 15. These positioning aid elements 32, extending in the exemplary embodiment of a support 10 depicted in FIG. 1, from one end region of the adjacent segment 15 to the adjacent end region of the adjacent segment 15 are disposed for the preliminary fixation of the adjacent segments 15 and the interposed end sections 20 of the framework elements 18 in a desired arrangement in the row 13. The positioning aid elements 32 are disposed to stop a movement of a segment 15 arranged in the row 13, of a framework element 18 and/or of an end element 23 relative to an adjacent element in row orientation R and/or in transverse direction, for example perpendicular direction, with respect to row orientation R.

For positioning the segments 15, the positioning aid element 32 is plugged into adjacent segments 15 and through the end sections 20 that are to be clamped between the segments 15. In doing so, a movement of the adjacent segments 15 relative to each other in transverse direction, for example in perpendicular direction, can be stopped in row orientation R. The positioning aid element 32 can be fastened to the segments 15 by means of fastening devices (not illustrated), in which case the fastening devices are arranged and set up in such a manner that the adjacent segments 15 that have been previously fixed in position next to each other are fixed in position tensioning the segments 15 with the tensioning element 14. Alternatively or additionally, the positioning aid elements 32 may comprise abutment elements (not illustrated) that come into contact as abutments with the end sides of the segments 15, so that the positioning aid elements 33 cannot be pushed too far into the segments 15. With the use of the positioning aid elements 32, the segments 15 and the truss girder elements 18 can be positioned and aligned precisely in a simple manner in preparation for tensioning the tensioning element 14. The row 13 of the segments 15 for the lower chord and/or for the upper chord that have been previously fixed in position and aligned relative to each other by the positioning aid elements 31 can form a continuous edge without offsets from one row end 25*a* to the opposite row end 25*b*. Referring to the end elements 23 of the exemplary embodiment shown by FIGS. 1 and 2, the portion of the end element 23 that extends through the end section 20 of the outer framework element 18 into the outer segment 15 forms the positioning aid element 32. A connection between the segments 15 by means of the positioning aid elements 32 in this exemplary embodiment acts, however, only for the preliminary fixation in order to facilitate handling of the segments 15 and the elements of the row 13 during assembly of the support 10. A connection between the adjacent segments 15 by means of the positioning aid elements 32 is preferably not suitable for absorbing the tensile forces acting on the lower chord 11 and occurring during use of the support 10 in the device, and for preventing the opening of gaps between adjacent segments 15. This primarily effects only the connection of the elements of the lower chord 11 by compressing the elements of the lower chord 11 by means of the pretensioned tensioning elements 14.

To do so, the tensioning elements 14 are arranged in the segments 15 so that the tie rods 26 extend through the row of segments 15. Then the tie rods 26 are pretensioned with the aid of the nuts 27*b* at a specified preliminary tension, so that the anchor elements 27*a*, 27*b*—in the exemplary embodiment the head 27*a*—brace themselves against the one end 25*a* of the row 13 and the nut 27*b* on the opposite end 25*b* of the row 13 against the end elements 23. In doing so, the elements arranged between the anchor elements 27*a*, 27*b* are braced with respect to each other. By stressing the support 10 with a load during operational use of the device in which the support 10 is used, it is possible for additional compressive forces to occur in the upper chord 12 while tensile forces act on the lower chord due to the load. The combined pretensioning force of the tensioning elements in the upper chord 12 can consequently be lower than the combined pretensioning force of the tensioning elements 14 in the lower chord 11. The assembled support 10 can then be arranged inside the device at its location of use.

The preliminary tension of the tensioning elements 14 in the lower chord is selected such that, even when loading the device in which the support 10 is used, i.e., with the maximum load for which the device is designed, no gaps will open between the adjacent segments 15. In addition, the preliminary tensioning of the tensioning elements 14 in the lower chord 11 and/or in the upper chord 12 is preferably selected such that, due to the clamping force acting between the adjacent segments 14 due to the preliminary tensioning is such that, when stressing with a maximum load for which the device is designed, there will not be any shifting of the adjacent segments 15 of the row 14 relative to each other in transverse direction, for example in perpendicular direction, with respect to the clamping force, or a shifting between the elements arranged between the adjacent elements, for example of an end section 20, relative to one or the other segment 15 in transverse direction, for example perpendicular direction, with respect to the clamping force. In particular in cases in which the coefficient of friction between the friction surfaces at a connection between adjacent segments 15 is low such that a sufficient clamping force cannot be applied to prevent a shifting, a positive locking element is preferably arranged on the adjacent ends 28*a*, 28*b* of the adjacent segments 15, in which case the arrangement is set up to prevent the shifting of the adjacent segments 15 relative to each other in upward direction and/or in downward direction, and/or in lateral direction, by means of positive locking. In one exemplary embodiment, in particular the exemplary embodiments depicted by the Figures, the positioning aid elements 32 may act as the positive locking elements.

Due to the pretensioning of the tensioning elements 14 of the lower chord 11, the support 10 arranged in the assembled device is preferably bent upward. In the case of a bridge crane with the support 10 according to the invention as the bridge support may be bent upward, for example, if there is no lifting load stressing the crane.

Two adjacent segments 15 of a row 13 are preferably held together only by the compressing forces exerted on the adjacent segments 15 from two directions, said forces being applied by means of the tensioning element or elements 14 for the row 13. Positive locking exists along the compressive forces. In transverse direction, for example in perpendicular direction thereto, there exists at least one friction connection.

Due to the segmented structural design, the support 10 can be transported in individual parts to difficultly accessible installation locations such as, for example, a ski station and a mountain station and be assembled on site.

The support 10, for example, may be a support for a bridge or a crane.

Figure 3:
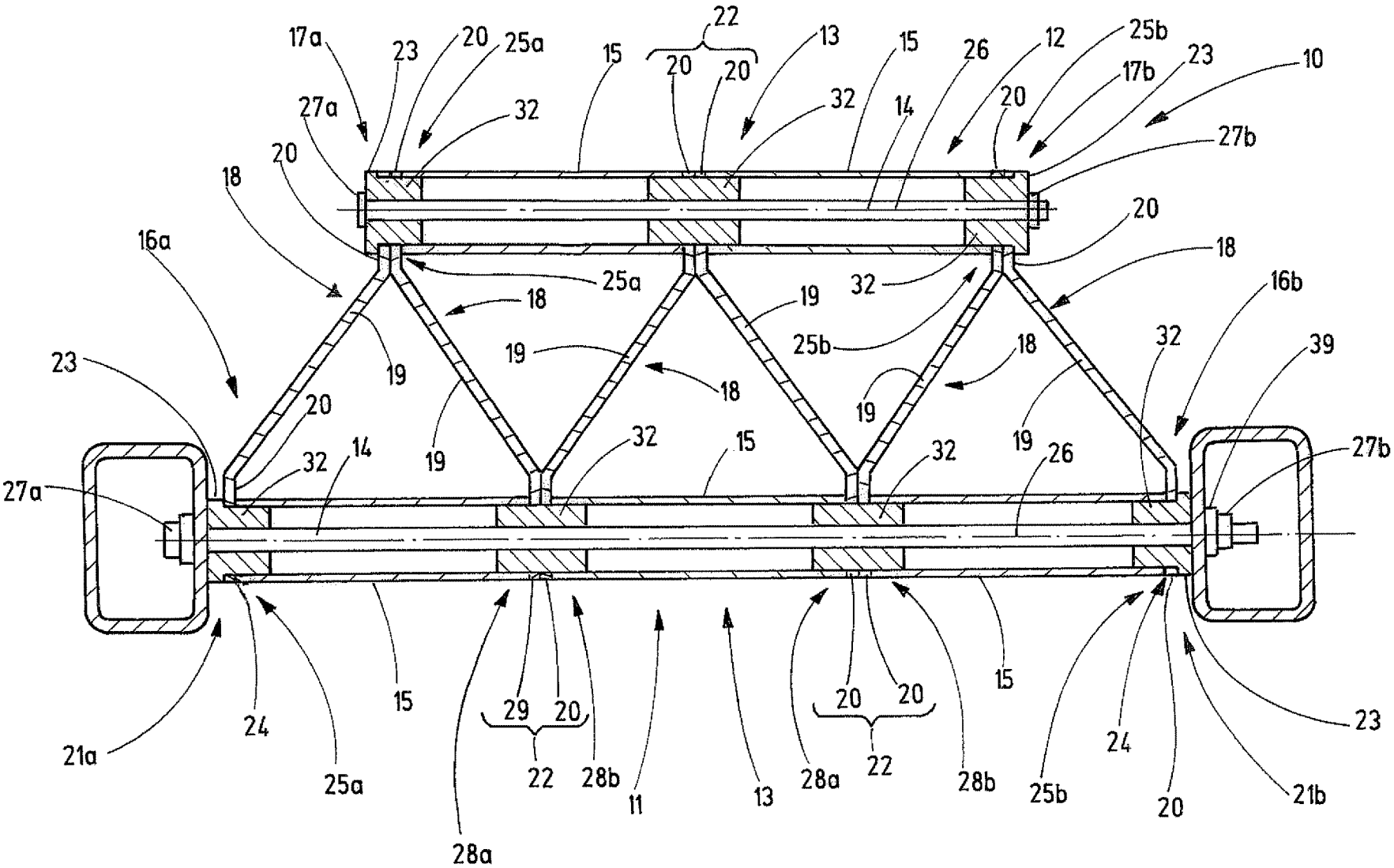
FIG. 3 is a longitudinal vertical section of a crane bridge having a truss constructed structural support in accordance with the invention.
Figure 4:
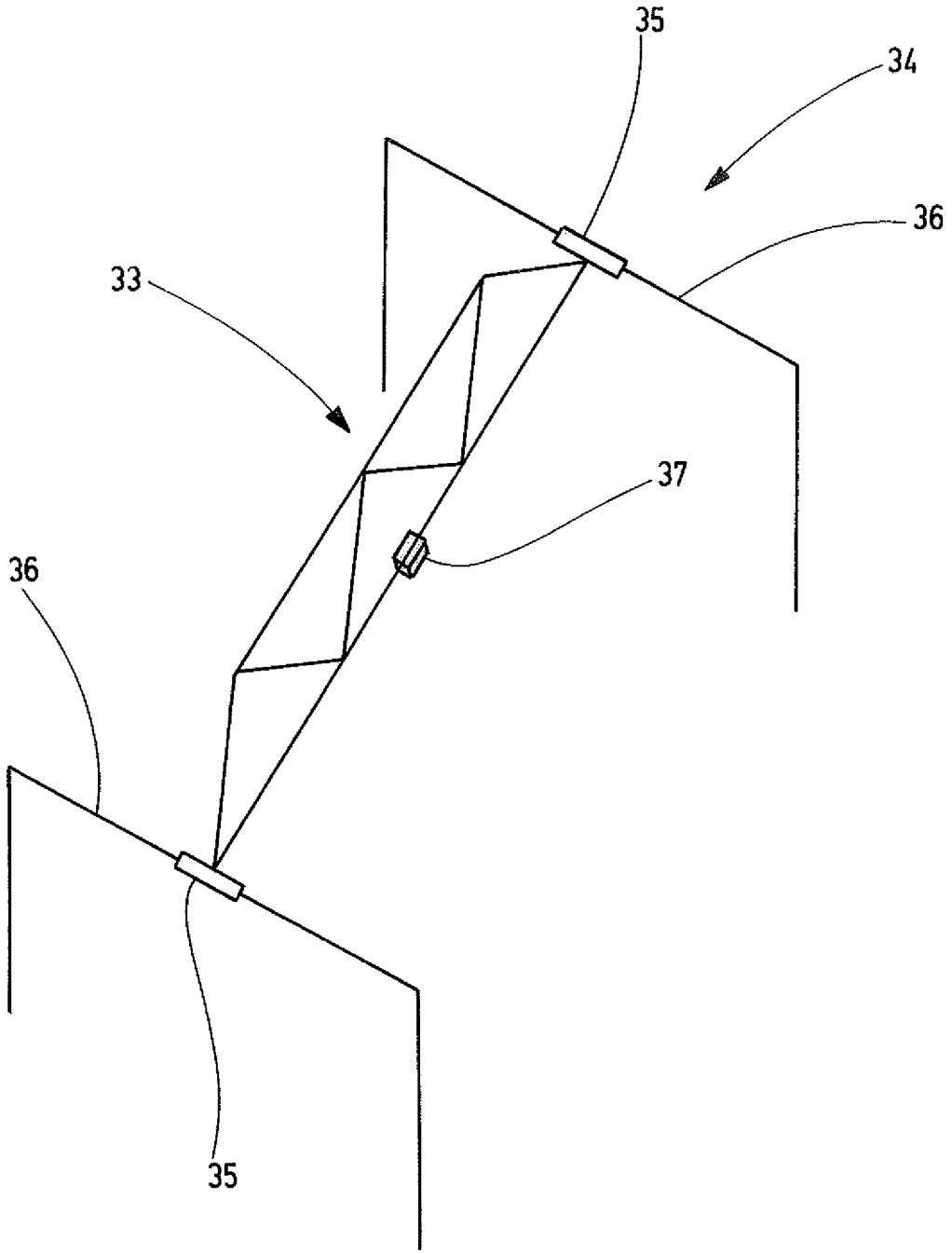
FIG. 4 is a schematic perspective of a bridge crane having a structural support in accordance with the invention.

FIG. 3 shows a longitudinal section through a crane bridge 33 with a support 10 as the bridge support 10 that essentially corresponds to the exemplary embodiment as in FIGS. 1 and 2. The crane bridge 33 is part of a bridge crane 34, in which case FIG. 4 shows an example in a highly schematic manner. The illustrated bridge crane 34 is a single girder bridge crane. The depicted crane bridge 33 for the single girder bridge crane comprises a support 10 according to the invention as the bridge support 10. The bridge support 10 is mounted between two end carriages 35 of steel or aluminum and fastened thereto. In the case of a double girder bridge crane, two bridge supports 10 according to the invention are arranged next to each other between the carriages 35. The bridge support 10 spans a working space A of the bridge crane 34. Wheels (not illustrated) are arranged on the carriages 35, said wheels allowing the crane bridge 33 comprising the bridge support 10 and carriages 35 to be moved back and force on the crane paths 36. A trolley 37 of the crane 34 can be supported so as to be movable on the flat section 30 of the lower chord 11.

The bridge support 10 is externally supported against the foundation via the two crane paths 36. The drawing of an example of the bridge crane 34 shows that, in a device 34 according to the invention, at least two or three successively arranged segments 15 of the row 13 can—due to the tensioning of the segments 15 of the row 13 by means of the tensioning element 14 extending through the row 13 against each other and, if any, due to a positive lock formed, for example by positive locking elements 32—span a space A created between two external supports of the support 10 relative to the foundation that is positionable without needing or having, between the two external supports, an additional external support of the at least two or three successively arranged segments 15 against the foundation, in particular of the three adjacent ends 28*a*, 28*b* of the at least two or three segments 15. This applies equally to a device 34 having a support 10 according to the invention configured as a truss girder support and to a device with a support configured as a box girder support divided into segments 15 designed according to the invention. With reference to a bridge or sign gantry according to the invention, the successive arrangement of at least two or three segments 15 of the row 13 may extend from one end of a bridge panel to another end of the bridge panel. For example, in the case of at least three successively arranged segments 15, a center segment 15 is clamped between the adjacent segments 15 due to being braced and can due to this and, if any, due to positive locking between two adjacent segments 15, be held over the spanned space without external support of the adjacent ends 28*a*, 28*b* of the middle segment and one or both of the adjacent segments 15 against the foundation.

Different from the exemplary embodiment according to FIG. 1, the tensioning elements 14 of the lower chord 11 are anchored in the end carriages 35 that are arranged at the ends 25*a*, 25*b* of the row 13 of the segments 15. The tensioning elements 14 brace themselves with their anchor elements 27*a*, 27*b*—according to the example with the head 27*a* and the nut 27*b* that are arranged in the end carriages 35—respectively from the inside against the wall 38 of the end carriage 35 or against an intermediate element 39 arranged between the anchor element 27*a*, 27*b* and the wall 38 of the end carriage 35. As a result of this, the end carriages 35 are pressed against the ends 25*a*, 25*b* of the row 13. In the exemplary embodiment, the end carriages 35 brace themselves against the end elements 23. Alternatively, for example, the end carriages 35 may brace themselves against the end sections 20 of the outer truss girder elements 18 that are respectively clamped between an end carriage 35 and the end side 24 of the adjacent outer segment 15. Otherwise, the end carriages 35 may brace themselves, for example against the end sides of the outer segments 15 of the row 13. In the exemplary embodiment, the support 10 is fastened to the end carriages 35 by means of the tensioning elements 14 of the lower chord 11. This makes the assembly of the crane bridge 33 particularly easy. The crane bridge 33 may be assembled analogously to the exemplary method illustrated above, wherein the tensioning elements 14 of the lower chord 11 are passed through the walls 38 of the end carriages 35.

Alternatively, the device may be a semi portal crane (not illustrated), for example. Such a crane has, only on one end of the support 10 according to the invention, an end carriage 35 that is preferably fastened by means of the tensioning elements 14 in the lower chord 11, said end carriage being movable on a crane path that is located on the upper end of the working space of the crane.

In the embodiments depicted by the Figures, the lower chord 11 is longer than the upper chord 12. Alternatively, the lower chord 11 and the upper chord 12 may have the same length, or the lower chord 11 may be shorter than the upper chord 12. Independent thereof, the lower chord 11 and/or the upper chord 12 of the truss girder support 10 may be fastened to end elements 35, for example end carriages 35.

Figure 5:
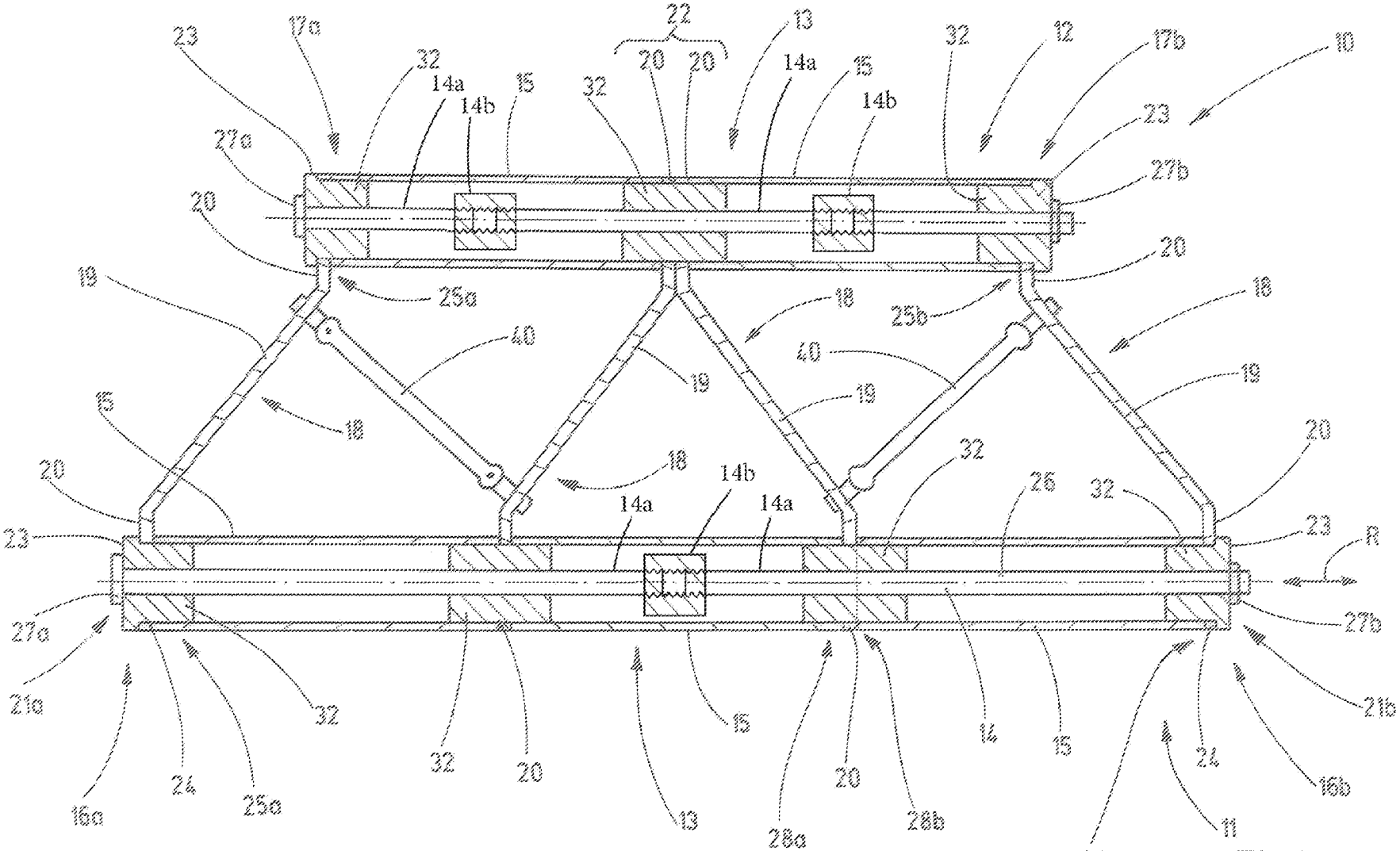
FIG. 5 is a further exemplary embodiment of a structural support in accordance with the invention having a length adaptation option.

FIG. 5 shows a longitudinal section through a further exemplary embodiment of a support 10 according to the invention. Essentially, the description in conjunction with FIG. 1 applies to this exemplary embodiment. Instead of a second framework element 18 between the outmost segments 15 of the rows 13 in the lower chord 11 and the upper chord 12 and the next adjacent segment 15, however, there is fastened—respectively to the outermost framework element 18 and the adjacent framework element 18—at least one turnbuckle 40 whose length is adjustable for adapting the angle of the turnbuckle 40 relative to the horizontal and the vertical. The lengths of the outermost segments 15 of the rows 13 in the lower chord 11 and the upper chord 12 can thus be adapted to provide a support 10 having a required length. The segments 15 of the rows 13 comprising at least three segments 15 arranged between the outermost segments 15 of the rows 13 may have uniform lengths.

Figure 6:
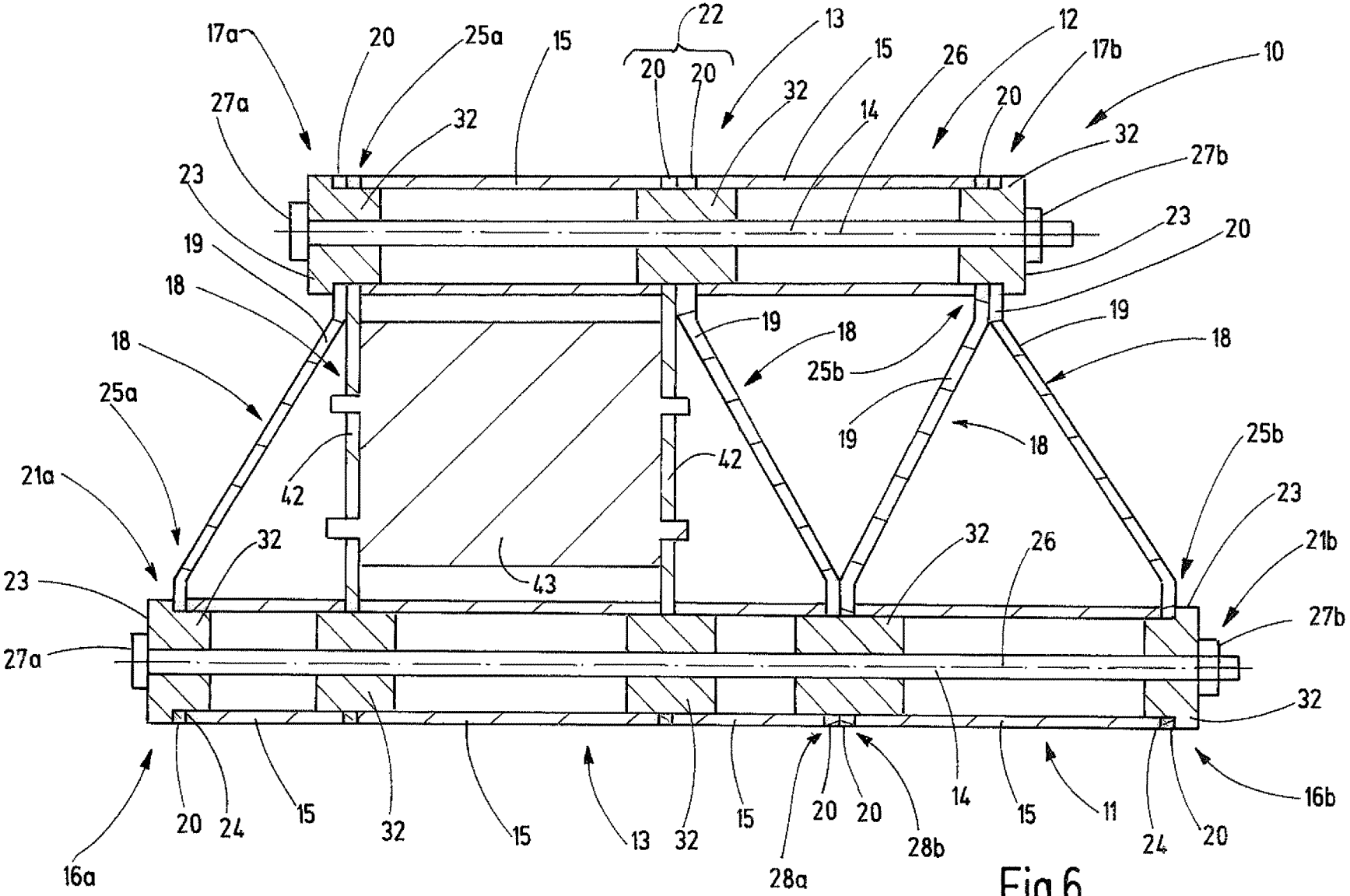
FIG. 6 is a longitudinal vertical section of an alternative embodiment of structural support in accordance with the invention having a further length adaptation option.

FIG. 6 shows a longitudinal section through a row of segments 15 in the lower chord 11 of the support and a row 13 of segments 15 in the upper chord 12 of another exemplary embodiment of the support 10. The support comprises at least two adjacent rows 13 in the lower chord 11 and at least two adjacent rows 13 in the upper chord 12. The support 10 has at least one length adaptation section 41 with two sheet metal elements 42 as the framework elements 18 that extend transversely, for example perpendicularly, with respect to row orientation R. The vertical sheet metal elements 42 are clamped between the segments 15 in the lower chord 11 and in the upper chord 12 by means of the pretensioned tensioning elements 14. Between the vertical sheet elements 42, there are arranged—in the lower chord 11 and the upper chord 12—the segments 15 whose lengths are adapted to provide a support 10 with a desired length. The segments 15 adjacent to the length adaptation section 41 also have the respectively adapted length. For stabilization, sheet metal stabilizing elements 43 are arranged between the vertical sheet metal elements 42, said stabilizing elements extending along the tensioning elements 14 and being fastened to the vertical sheet metal elements 42, for example by welding or hinging. Other than that, the description regarding FIG. 1 applies analogously.

Alternatively or additionally to the options for providing a support 10 with the appropriate length depicted by FIGS. 5 and 6, the angle with respect to the horizontal or the vertical of sections 19 of the framework elements 18 that extend at an inclination with respect to the horizontal or the vertical, said framework elements 18 being clamped between the segments 15, can be can be adapted to be able to use segments 15 with adapted desired length.

Figure 7:
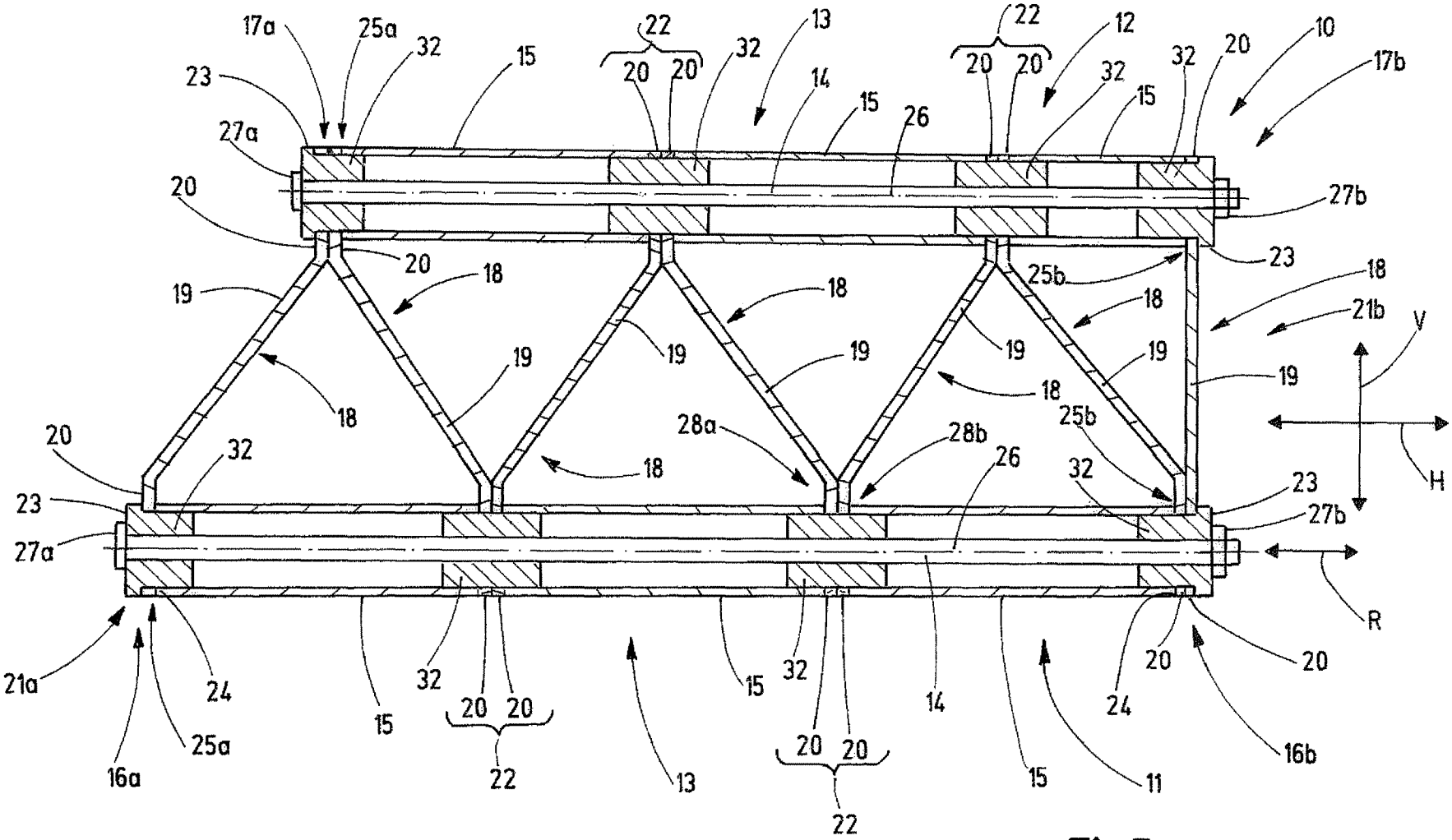
FIG. 7 is a longitudinal vertical section of a further exemplary embodiment of a structural support in accordance with the invention.

The truss girder support 10 according to the invention may be ended on one end 21*a*, 21*b* or on both ends 21*a*, 21*b* with a framework element 18 (post) arranged vertically relative to the lower chord 11 and or the upper chord 12. In conjunction with this, FIG. 7 shows an exemplary embodiment of an inventive truss girder support 10 having a lower chord 11 and an upper chord 12 that end flush with one end 21*b* of the support 10 while the upper chord 12 projects on one end 21*a* of the support 10 beyond the lower chord 11. The vertical framework element 18 is clamped between the end elements 23 of the lower chord 11 and the upper chord 12 and the ends 25*b* of the rows 13 of adjacent segments 15 by means of the tensioning element 14. Alternatively, the upper chord 12 and the lower chord 11 may have the same length, for example, in which case a vertical framework element 18 is arranged on each end 21*a*, 21*b*. Other than that, the descriptions regarding the other embodiments apply analogously in conjunction with the embodiment explained in conjunction with FIG. 7.

Figure 8:
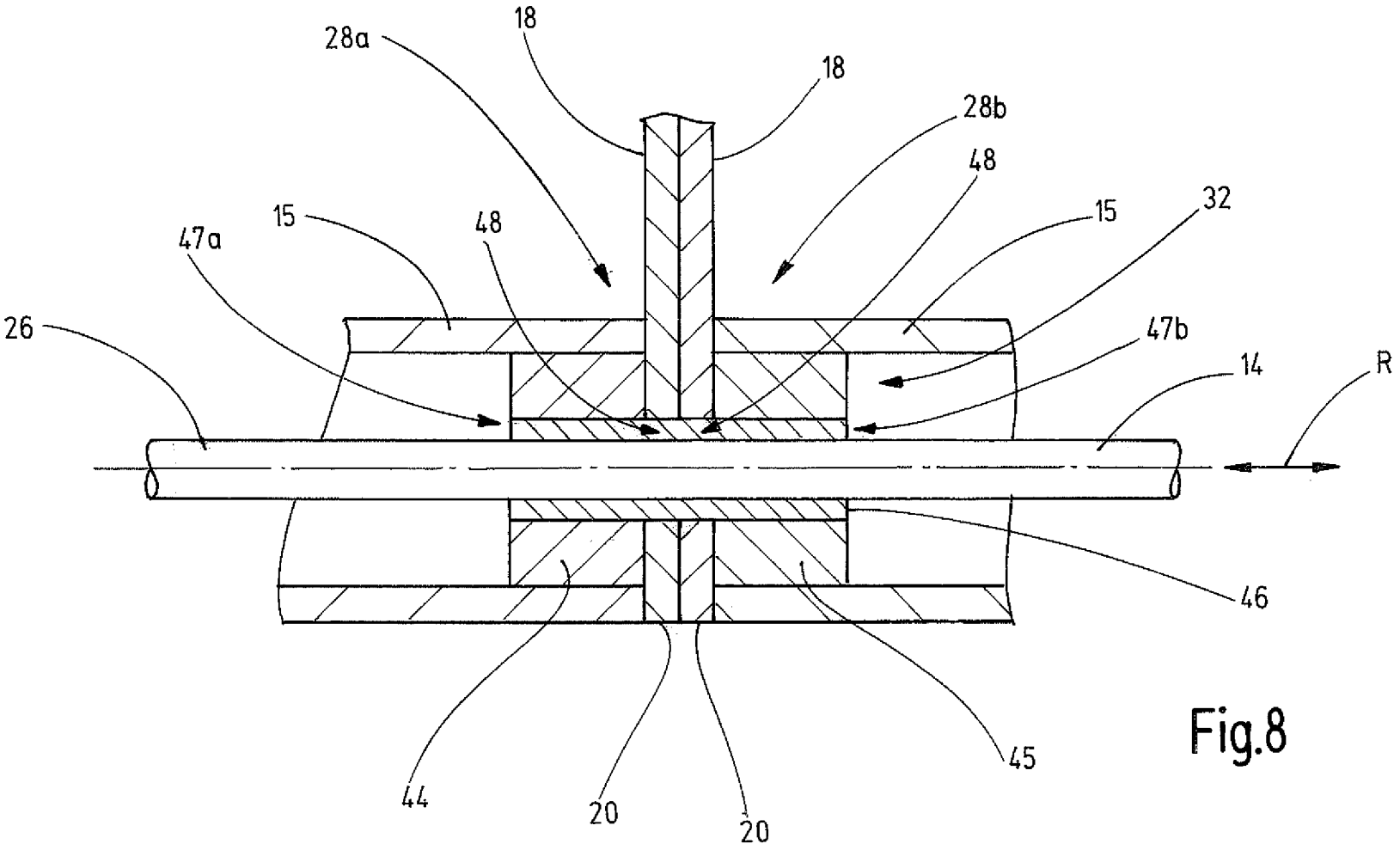
FIG. 8 is an enlarged fragmentary section of a positive locking element for use in the illustrated structural support.

Each of the positive locking elements 32 of the support 10 according to the invention may consist of multiple parts. For example, FIG. 8 shows a multi-part positive locking element 32 to provide a positive lock between two adjacent segments 15 in the lower chord 11 and/or the upper chord 12, as can be used, for example, in one of the described embodiments. The positive locking element 32 comprises a first part 44 that is arranged in a section on one end 28*a* of one of the adjacent segments 15, preferably in a precision fit, and a second part 45 that is arranged in a section at the adjacent end 28*b* of the other of the adjacent segments 15, preferably in a precision fit. Furthermore, the positive locking element comprises a third part 46 that is arranged, preferably in a precision fit, in respectively one receptacle 47*a*, 47*b* of the first part 44 and the second part 45. The tensioning element or elements 14 extend through the third part 46. The first, second and third parts 44, 45, 46 may consist of aluminum or steel, for example. The first part 44, the second part 45 and the third part 46 together convey the positive lock between the adjacent segments 15, transversely with respect to the orientation of the clamping force due to the tensioning element or elements 14 that are tensioned in longitudinal direction. The third part 46 has an outer width and/or height that is smaller than the outer width and/or height of the first and second parts (width and/or height, respectively, in transverse direction with respect to the longitudinal direction of the adjacent segments 15 or transverse with respect to the row orientation R). The third part 46 is arranged, preferably in a precision fit, in the recesses 48 in the end sections 20 of the framework elements 18. The third part 46 extending through the recesses 48 in the end sections 20 in the receptacle 47*a* of the first part 44 and the receptacle 47*b* of the second part 45 conveys a positive lock in a direction transverse to the clamping force direction between the end sections 20 and via the first part 44 and the second part 45 between the end sections 20 and the adjacent segments 15. The multi-part embodiment of the positive locking elements 32 requires only relatively small recesses 48 in the end sections 20 to receive the positive locking elements 32—here the third part 46 of the positive locking element 32. The tensioning element or elements 14 on the ends 28*a*, 28*b* of the segments 15 do not form positive locking elements transverse to the clamping force. The arrangement of the third part 46 in the first part 44 and the second part 45 and the arrangement of the first part 44 in the segment 15 and the second part 45 in the segment 15 are set up such that there is no shifting of the segments 15 relative to each other or a shifting of the end sections 20 relative to each other in a direction transverse to the clamping force in such a manner that a force transverse to the clamping force at the ends 28*a*, 28*b* would be exerted on the tensioning element or elements 14. The outside dimensions of the first part 44 and the second part 45 are appropriately adapted to the inside dimensions of the segments 15 at the ends 28*a*, 28*b*, and the outside dimension of the third part 46 is appropriately adapted to the inside dimension of the recesses 48 in the end sections 20 and to the inside dimensions of the receptacles 47*a*, 47*b* in the first part 44 and the second part 45. On the adjacent ends 28*a*, 28*b* of adjacent segments, the tensioning element or elements 14 are preferably at least minimally at a distance from the positive locking elements 32 of the row 13, independent of a single-part or multi-part design of the positive locking elements 32. In order to produce a positive locking connection during the assembly of the support 10, for example, the first part 44 is plugged into the section at the end 28*a* of the segment 15. Then, for example, the framework element 18 is arranged on the end 28*a* of the segment 15, and the third part 46 is plugged into the recess 48 in the end section 20 of the framework element 18 and into the receptacle 47*a* of the first part 44. An end section 20 of an additional framework element 18 can then be pushed onto the third part 46. Finally, for example, the second part 45 is pushed onto the third part 46, and the adjacent segment 15 is pushed onto the second part 45. Alternatively, it is possible to start at the end 28*b*, for example. The first part 44, second part 45 and/or third parts 46 may be associated with fixation means (not illustrated) in order to fix the first part 44, the second part 45 and/or third parts 46, during assembly, in row orientation R. The multi-part positive locking element 32 acts as a positioning aid element 32 during assembly.

The support 10 according to the invention comprises at least one row 13 of segments 15 arranged next to each other, in which case a row 13 preferably extends from one end 21*a* of the support 10 to the opposite end 21*b* of the support 10. In a preferred embodiment, there extends, through the at least one row 13, at least one tensioning element 14 that can also be referred to as a tie rod and that is anchored at the ends 25*a*, 25*b* of the row 13 and pretensioned with respect to the row 13 in order to hold the segments 15 of the row 13 together. In doing so, the adjacent segments 15 are braced with respect to each other on their end sides 24 by means of the tensioning element or elements 14, in which case—between the end sides 24—one or more than one element such as, for example a metal sheet, or no element, may be arranged. The connection of adjacent segments 15 of the row 13 to each other by pretensioning the pretensioning element or elements 14 of the row 13 with respect to the row 13 is preferably high such that additional connecting means for connecting the adjacent segments 15 of the row 13 are not necessary. Therefore, preferably, there does not exist an integrally bonded connection such as, for example a weld connection, and/or screw connection, between two adjacent segments 15 of a row 13 for the connection of adjacent segments 15 to each other, said segments potentially being loaded in tension along the longitudinal extent of the row 13 during the operational use of the support 10 in an assembled device 33, 34. In the exemplary embodiments, a positive locking connection may exist between adjacent segments 15, said connection preventing a shifting of the adjacent segments 15 relative to each other or an element arranged between the adjacent segments 15, e.g., a framework element 18, relative to one of the segments 15, transverse, for example perpendicular, to the clamping force exerted by the tensioning element. The support 10 can be provided at a location of use in that the individual segments 15 are transported to the location of use and are only set up there to form the row 13 and braced with respect to each other by means of the tensioning element 14.

Exemplary embodiments of the device 34 according to the invention comprise at least one support 10 with one row 13 of at least three successively arranged segments 15, wherein the segments 15 of the row 13 are braced with respect to each other by means of a tensioning element 14 extending in the support 10, wherein the tensioning element 14 extends through the row 13, wherein the tensioning element 14 is anchored to the opposite ends 25*a*, 25*b* of the row 13 of segments 15 in order to brace the segments 15 of the row 13 with respect to each other, and wherein, between two adjacent segments 15 of the row 13, a positive lock is formed in order to prevent a movement of the adjacent segments 15 relative to each other in a direction transverse to the longitudinal extent direction of the segments 15 by means of the bracing of the segments 15 of the row 13 with respect to each other by means of the tensioning element 14 and the positive lock, without the existence of an external support of the adjacent ends 28*a*, 28*b* of the segments 15 relative to the foundation.

LIST OF REFERENCE SIGNS

| | |
|---|---|
| 10 | Support |
| 11 | Lower chord |
| 12 | Upper chord |
| 13 | Row |
| 14 | Tensioning element |
| 15 | Segment |
| 15a | Bottom |
| 15b | Lateral walls |
| 15c | Cap |
| 16a, b | Ends of the lower chord |
| 17a, b | Ends of the upper chord |
| 18 | Framework element |
| 19 | Framework element section |
| 20 | End section |
| 21a, b | Ends of the Support |
| 22 | Stack |
| 23 | End element |
| 24 | End side |
| 25a, b | Ends of the row |
| 26 | Rod |
| 27a, b | Anchor elements |
| 27a | Head |
| 27b | Nut |
| 28a, b | Adjacent ends of neighboring segments |
| 29 | U-beam |
| 30 | Flat section |
| 31 | Rectangular tube |
| 32 | Positioning aid element/positive locking element |
| 33 | Crane bridge |
| 34 | Bridge crane |
| 35 | End carriage |
| 36 | Crane path |
| 37 | Trolley |
| 38 | Wall |
| 39 | Intermediate element |
| 40 | Turnbuckle |
| 41 | Length adaptation section |
| 42 | Vertical sheet metal element |
| 43 | Stabilizing element |
| 44 | First part |
| 45 | Second part |
| 46 | Third part |
| 47a, b | Receptacles |

-continued

| | |
|---|---|
| 48 | Recess |
| L | Length of a segment |
| A | Working space |
| H | Horizontal |
| B-B | Section plane |
| P | Arrow |
| R | Row orientation |

The invention claimed is:

1. A structural support (10) comprising:

two rows (13) of at least two successively arranged structural segments (15); one of said rows of structural segments (15) forming an upper cord (12) of the structural support (10) and another of said rows (13) forming a lower cord (11) in vertically displaced relation to the upper cord (12);

positioning elements (32) disposed within adjacent ends of the structural segments (15) of each row (13) and spaced apart from each other for positioning the structural segments (15) with respect to each other;

and frame elements (19, 40) interconnecting the upper and lower cords (12, 11);

said structural segments (15) of the each row (13) being braced with respect to each other by a respective tensioning element (14) extending inside the support (10); and each tensioning element (14) being anchored to opposite ends (25*a,b*) of the respective row (13) of structural segments (15) in order to brace the structural segments (15) of the row (13) with respect to each other, and each tensioning element being a rod comprising a plurality of axially interconnected rod segments (14*a*).

2. The structural support (10) of claim 1 wherein two adjacent structural segments (15) of each row (13) are braced together without an integrally bonded connection therebetween for securing the adjacent structural segments (15) to each other.

3. The structural support (10) of claim 1 wherein two adjacently arranged structural segments (15) of each row (13) are braced together without a weld or screw connection therebetween for securing the adjacent segments (15) to each other.

4. The structural support (10) of claim 1 wherein said tensioning element (14) of each row extends through the structural segments (15) of each row (13).

5. The structural support (10) of claim 1 wherein said each row (13) of structural segments (15) extends from one end (21*a*) of the structural support (10) to an opposite end (21*b*) of the structural support (10).

6. The structural support (10) of claim 5 wherein each tensioning element (14) is anchored to one end (25) of the row (13) outside the structural segments (15) of the row (13).

7. The structural support (10) of claim 5 wherein each tensioning element (14) is anchored to both ends (25*a*, 25*b*) of the row (13) outside the row (13) of structural segments (15).

8. The structural support (10) of claim 1 wherein the length (L) of the individual structural segments (15) of each row (13) is no more than 1.2 meters.

9. The structural support (10) of claim 1 wherein each structural segment (15) has a bottom (15*a*), a cap (15*c*), as well as two lateral walls (15*b*) extending in row orientation (R).

10. The structural support (10) of claim 1 wherein said structural support (10) is a truss girder.

11. The structural support (10) of claim 1 wherein between the lower chord (11) and the upper chord (12) there are arranged framework elements (18) extending in an inclined manner relative to the Vertical, and at least one end section (20) of a framework element (18) being held between adjacent structural segments (15).

12. A device comprising at least one support (10) according to claim 1.

13. The device of claim 12 including at least one end carriage (35) arranged on one end (21*a,b*) of the support (10), and said tensioning element (14) is anchored in the end carriage (35) for bracing the end carriage (35) against one of the structural segments (15) of the row (13).

14. A method of providing and assembling the structural support of claim 1 including the steps of:

providing the structural segments (15) and the tensioning element (14) at a construction site at the location of use;

arranging the provided segments (15) to form a row (13) at the construction site; and bracing the structural segments (15) arranged in the row (13) with respect to each other by means of the tensioning element (14) at the construction site.

* * * * *